US007478641B2

(12) United States Patent
Rousselet

(10) Patent No.: US 7,478,641 B2
(45) Date of Patent: Jan. 20, 2009

(54) DEVICE FOR THE COMBINED PRESENTATION OF TWO ITEMS

(75) Inventor: Guilhem Rousselet, Saint-Maur-des-Fossés (FR)

(73) Assignee: L'Oreal (FR)

( * ) Notice: Subject to any disclaimer, the term of this patent is extended or adjusted under 35 U.S.C. 154(b) by 103 days.

(21) Appl. No.: 10/690,773

(22) Filed: Oct. 22, 2003

(65) Prior Publication Data

US 2005/0087207 A1 Apr. 28, 2005

(51) Int. Cl.
*A45D 40/24* (2006.01)

(52) U.S. Cl. ..... 132/318

(58) Field of Classification Search ..... 132/297, 132/317, 318; 206/159, 160, 145, 433, 823; 24/288, 545, 570, 298; 215/386; 220/23.4
See application file for complete search history.

(56) References Cited

U.S. PATENT DOCUMENTS

| | | | | | |
|---|---|---|---|---|---|
| 2,637,475 | A * | 5/1953 | Gialanella | 294/159 |
| 2,949,204 | A * | 8/1960 | Edwards | 215/321 |
| 3,033,412 | A * | 5/1962 | Fox | 220/23.4 |
| 3,186,704 | A * | 6/1965 | McCloskey et al. | 269/9 |
| 3,924,738 | A * | 12/1975 | Poupitch | 206/150 |
| 4,649,666 | A * | 3/1987 | Ness et al. | 47/43 |
| 4,655,000 | A * | 4/1987 | Swick et al. | 47/44 |
| 5,191,975 | A * | 3/1993 | Pezzoli et al. | 206/151 |
| 5,697,129 | A * | 12/1997 | Newville | 24/339 |
| 6,138,688 | A * | 10/2000 | Lombardi, Jr. | 132/297 |
| 6,298,525 | B1 * | 10/2001 | Margo | 24/336 |
| 6,371,131 | B1 * | 4/2002 | Finocchiaro et al. | 132/297 |
| 6,533,148 | B1 | 3/2003 | Dahl | |
| 6,718,691 | B2 * | 4/2004 | Taylor | 47/44 |
| 2003/0041870 | A1 * | 3/2003 | Su et al. | 132/297 |
| 2003/0062060 | A1 * | 4/2003 | Burroughs | 132/297 |
| 2004/0129600 | A1 * | 7/2004 | Gueret | 206/581 |

FOREIGN PATENT DOCUMENTS

| | | |
|---|---|---|
| CA | 2203195 | 10/1998 |
| CH | 447929 | 11/1967 |
| FR | 2771388 | 5/1999 |
| JP | 58-122514 | 7/1983 |

* cited by examiner

*Primary Examiner*—Robyn Doan
*Assistant Examiner*—Rachel A Running
(74) *Attorney, Agent, or Firm*—Lerner, David, Littenberg, Krumholz & Mentlik, LLP

(57) ABSTRACT

A device for the combined presentation of first and second items includes first and second elements, each detachably securable to the first item and the second item. The first and second elements are adapted to resiliently engage the first and second items. A connecting member interconnecting the first element and the second element is resiliently foldable between a relaxed configuration in which the first and second elements are coplanar, and a folded configuration in which the first and second elements are coaxially aligned.

27 Claims, 2 Drawing Sheets

DEVICE FOR THE COMBINED PRESENTATION OF TWO ITEMS

BACKGROUND OF THE INVENTION

The present invention concerns an accessory for the combined presentation of at least two items, in particular two items for cosmetic use. The items may be two separate distinct products, or the two items may include a product and an accessory which is adapted for application of the product.

This provides advantages especially in the field of make-up due to the increasing sophistication of the make-up art, which often involves the use of two complementary products to be applied separately.

This is the case, for example, with lipsticks, wherein a first product may provide the color and a second so-called "finishing" product provides, if necessary, the gloss or hold-fast properties for the first product. An example of other make-up products that may require separate applications of elements is cosmetics for the eyes and the nails, where one of the products may be a make-up foundation and the other product may be the so-called make-up proper.

In the case of the above-mentioned two complementary products, as well as others, it is therefore convenient to have two packagings that must be able to be available either simultaneously or independently of one another according to the habits and needs of the consumer.

However, there is an underlying problem of trying to produce a device that selectively allows either of two products to be had in a combined manner, so as to be available at any time, or have two products separate, in particular, when the consumer so desires to only have one within their person.

In the case of the second option, an additional problem may arise. On the one hand, if an additional device is used to unify the two products, care must be taken so that the additional device is not lost when the two items are separated from one another, and/or from the additional device. On the other hand, the additional device, while it remains unified with only one of the two products, must not interfere with the use of the product and should not noticeably increase its dimensions.

For example, in the area of food, devices are known that allow the combination of two or more items in the form of packs, i.e., with bottles of water or milk. When one or more bottles are removed from the pack, the "unoccupied" portions of the loop cause an unnecessary increase in dimensions. Similar examples exist in the prior art; however, many of those examples suffer from the same drawback.

Additional prior art references describe structures that have a functional use solely when in planar configuration, where a set of loops cannot be superimposed upon each other. For example, some references describe systems having a flexible strap terminating with two loops intended to form a handle for the combined transport of two bottles. The securing of one bottle relative to the other is achieved by making the flexible strap into a double loop similar to a figure 8 and inserting the neck of each of the bottles inside one of the sections of the figure 8 loop.

A disadvantage of such a configuration results from the fact that the assembly of the two bottles by means of such a flexible strap, by virtue of the complexity of the required manipulation, can be difficult to perform in an automated manner. Furthermore, following removal of one of the bottles, the strap cannot remain integral with the other bottle and the strap runs the risk of being lost.

Still, yet other prior art references describe systems having at least two loops connected together by a flexible grab handle. Each loop has a circular hole allowing an item to be retained securely therein. But these devices pose a problem because as a result of the means of retention arranged around the inner periphery of these holes, flexibility is reduced or even eliminated. Also, it is difficult to completely remove and then replace the items in their holes and this may take several attempts. Moreover, in order to remove an item from its hole, it is necessary to slide it along the entire length of the handle through the hole. This rules out being able to retain items in such holes that are not necessarily cylindrical.

So, one of the objects of the present invention is to create a device that allows a full or partial solution to the problems discussed above with regard to conventional devices.

A particular object of the present invention is to create a device that allows the combined presentation of at least two products. The present invention further contemplates that when the two items are separated from one another, the device may remain integral with any one of the products without unduly increasing the dimensions of the product it is integral with, as well as not interfering with the use of the product.

Another object of the present invention is to create such a device that is simple to use and economical to create.

The device according to the present invention solves the above problems by offering a retaining element that holds the items by latching. The retaining element may be in the form of a squeezing device. The squeezing device may be formed by two arms that are able to deform elastically and have an internal periphery that is complementary to the articles that can be retained by it. For example, these arms may be arranged in an arc or a circle and the squeezing device may form an open loop as viewed from above.

Further objects will be described in greater detail in the detailed description that follows.

SUMMARY OF THE INVENTION

According to the present invention, these objects are achieved by producing a device for the combined presentation of at least two items. The device includes a first element able to be secured in a detachable fashion to a first item, and a second element connected to the first and able to be secured to a second item. In order to allow the first item to remain fixed in relation to the second, the device is configured in such a way as to be able to occupy a position in which the first and second elements are both fixed on either the first or second item alone. The first element and the second element may be in the form of a squeezing device in order to be fixed to the two items.

The fixing of the second element to the second item is preferably also reversible, thus being detachable.

So, with the configuration according to the present invention, the two items can be either presented in a combined manner, by one being held fixed in relation to the other, or separate from one another. In the latter case, the fixing device may remain integral with one of the items. The element serving to secure the article that has been removed is itself able to be fastened to the remaining item, thereby allowing the latter not to have a noticeable increase in dimensions.

Preferably, the squeezing device includes two arms that are elastically deformable and the attaching of the first element (or the second) on the first item (or the second) works by latching. Such latching can take place on an item having a circular cross-section or a cross-section having any other form, in particular, square, hexagonal, pentagonal or the like.

The first element may be connected to the second by a film hinge or by a flexible strip. The device may be obtained by molding a thermoplastic material such as a polyethylene, a polypropylene, an SBS, an SEBS, a mixture of two or more of these materials, or a duroplastic polymer. Other materials may also be used.

In reality, in the case of the process for creating the device in a single molded part, in which the attachment of the fixing elements on the items takes place by latching, a number of factors have to be taken into account. First, the material must be able to deform elastically without breaking. Second, the material must be sufficiently rigid in order that, once the latching has taken place, there is a solid attachment of the fixing elements on the items. Third, the material must be able to withstand multiple flexions of an angle of approximately 180° without rupturing.

As previously mentioned, the possibility exists of using two different materials to form the device. One material may be used to form the link between the two fixing elements and is chosen for its flexibility and good properties of resistance to flexion. The other material may be used to form the fixing elements and is chosen based on its properties of rigidity and elastic deformation. In this instance, the device may be created by bi-injection or over-molding of two physically and chemically compatible materials.

Alternatively, the first and second elements may be molded separately in a mold (possibly the same one, if the first and second elements are identical) and then connected to one another by high frequency welding.

Preferably, the first element includes a first open loop, the two extremities of which delimit an opening via which the first element is latched on a portion of the first item. The first item may have a cross-section corresponding to an internal cross-section of the first open loop. The second element includes a second open loop also having two extremities. The extremities delimit an opening via which the second element is latched on a portion of the second item with a cross-section corresponding to an internal cross-section of the second open loop. The first and second elements are linked by a linking element preferably arranged opposite the opening of the first and second loops. The linking element is configured so that the device can move from an initial position in which the first and second elements are located on a side of a plane that is perpendicular to the mid-plane of the first and second open loops. Alternatively, the linking element can move to a second position in which the first and second elements are located on a side of a plane that is parallel to the mid-plane of the first and second loops.

The first and second open loops preferably have a circular internal cross-section, the first and second items being of corresponding circular cross-section over at least part of their height.

In the latter case, the portion of the circle formed by the first and second open loops extends over more than 180°, and preferably over an angle of between approximately 190° and 315°.

Still, according to this configuration, the parts of circular cross-section of the two items may have a similar or even identical diameter. With identical fixing elements, any differences in diameter between the two items, provided these remain within a certain limit, simply involve differences in the degree of clamping of the first and second fixing elements on the first and second items, or, in the amplitude of play when there is no clamping. In the latter case, however, the first and second items may be provided with means, in particular in the form of axial stops, to more or less reduce, if not eliminate, any relative axial movement between the fixing elements and the items.

Preferably, the radius of the portion of the circle formed by at least one of the first and second open loops is less than or equal to the radius of the portion of circular cross-section of the first item, as well as the radius of the portion of circular cross-section of the second item. Under these conditions, at least one of the fixing elements exerts a clamping force on the article to which it is secured.

By way of indication, the radius of the portion of the circle formed by at least one of the first and second loops may be approximately 1 to 10% less than the radius of the portion of circular cross-section of the first item and the second item.

The first and second elements are preferably identical, thereby making the orientation of either the first or second element with either the first or second item immaterial.

The first and second loops may be directly connected to one another or connected together at two diametrically opposed points of a closed loop, in particular via a film hinge. Thus, a first open loop is intended to catch by latching on a first item. The closed loop is attached to a third item by one of the ends of the latter and held by clamping on the third item. A second open loop is intended to catch by latching a second item. As a result of this, in the assembled position, the three items are arranged side-by-side, with the third item being arranged between the first and second items. When in use, there are various possibilities according to the nature of the three items. For example, the consumer can separate the first and second items from their respective fixing elements, the latter then being folded back to 180° and fixed by latching on the third item.

According to another aspect of the present invention, an assembly includes a first item and second item, in particular, in the form of receptacles containing a first product, in particular, a cosmetic product. The second item may also be an accessory for the application of the first item. The first and second items are held fixed in relation to each other by a device according to the present invention.

Preferably, on at least one portion of their height, the first and second items are of circular cross-section. More preferably, the first and second items more or less form a cylinder along their entire height.

In one embodiment, the first item may contain a first make-up product, in particular, for the lips or eyelashes, with the second item containing a second product intended to modify the appearance of the first, in particular, its gloss. The second product is preferably intended to cooperate with the first product in the application of make-up to the same area.

BRIEF DESCRIPTION OF THE DRAWINGS

The present invention includes, apart from the above arrangements, a number of other arrangements that will be explained below in relation to non-limiting examples described by reference to the annexed figures, in which.

DETAILED DESCRIPTION

Figure 1:
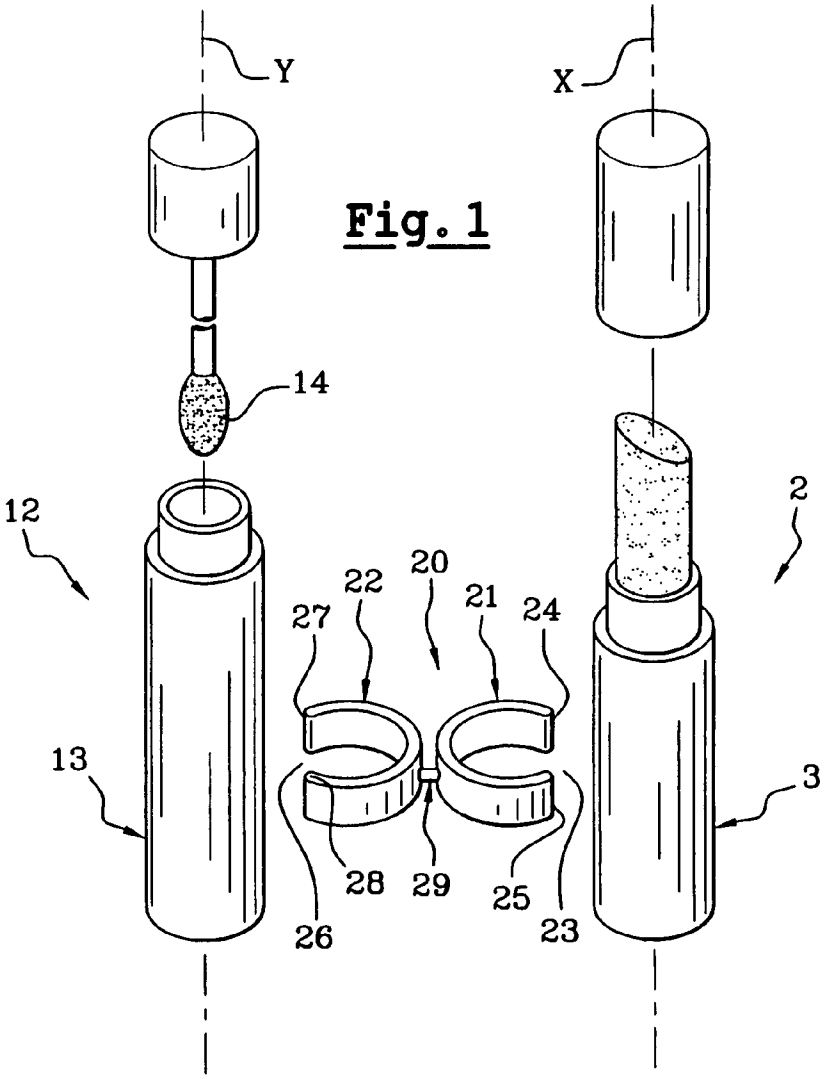
FIG. 1 shows an exploded view of an assembly according to a first embodiment of the present invention.

Assembly 1, which is now going to be described by reference to FIGS. 1-3, includes a first cosmetic item 2 in the form of a cylindrical case 3 having a longitudinal axis X and containing a solid piece of lipstick.

Assembly 1 also includes a second item 12 in the form of a cylindrical case 13 having a longitudinal axis Y. The external diameter of the cylindrical case 13 may be more or less identical with that of cylindrical case 3. Cylindrical case 13 may define a reservoir containing a liquid composition intended to be applied to the lips following application of the product contained in the first cosmetic item, in such a way as to modify the lipstick, i.e., gloss. To this end, an applicator 14 is integral with a cap that seals off the reservoir.

The assembly also includes a device 20 allowing the two items 2 and 12 to be presented in a combined manner. The device 20 may be obtained by molding polyethylene. It may include identical loop sections 21 and 22.

A portion of loop 21, as shown in FIG. 1, includes an opening 23 configured in such a way that it engages by latching with the cylindrical case 3 of the lipstick case. Latching includes but is not limited to squeezing. To this end, the distance between the edges 24 and 25, delimiting the opening 23, may be approximately 5 to 10% less than the external diameter of the case 3. The internal diameter of the portion of loop 21 is 5% less than the external diameter of case 3, such that the portion of loop 21, once mounted on the case 3, clamps the latter.

A portion of loop 22 may include an opening 26 configured in such a way that it engages by latching with the cylindrical case 13 containing the liquid composition. To this end, the distance between the edges 27 and 28, delimiting the opening 26, is less than the external diameter of the case. The internal diameter of the portion of loop 22 may be 5% less than the external diameter of the case 13, such that the portion of loop 22, once mounted on the case 13, clamps the latter.

Between the two portions of loop 21 and 22, opposite the openings 23 and 26, a link element 29 in the form of a short (on the order of a few mm) cylindrical strip is arranged. The strip 29 must be sufficiently short in order that when the device 20 is in the position as shown in FIG. 2, that is to say with the two sections of loop 21 and 22 located next to each other, it provides a relatively rigid link between the two portions of the loops. The strip must also be sufficiently long in order to be able to be placed in the configuration of FIG. 3 in which the two portions of loop 21 and 22 are arranged on top of each other, and fixed to the same item.

Figure 2:
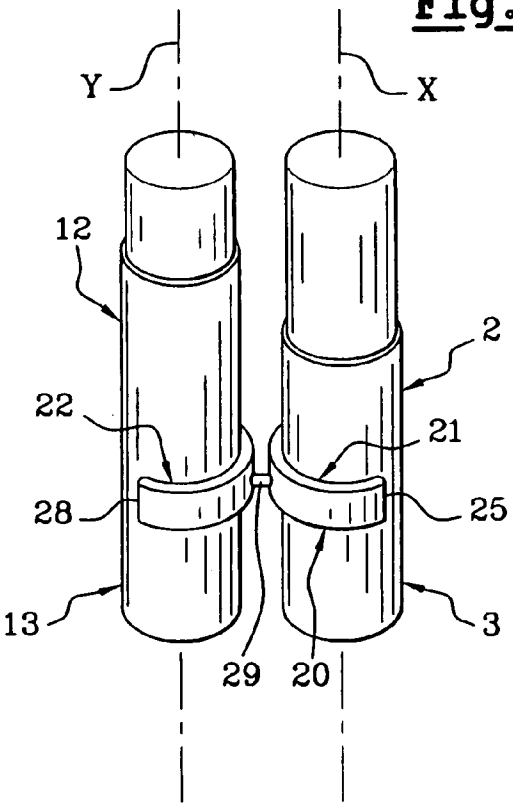
FIG. 2 shows a view in the assembled state of the assembly shown in FIG. 1.
Figure 3:
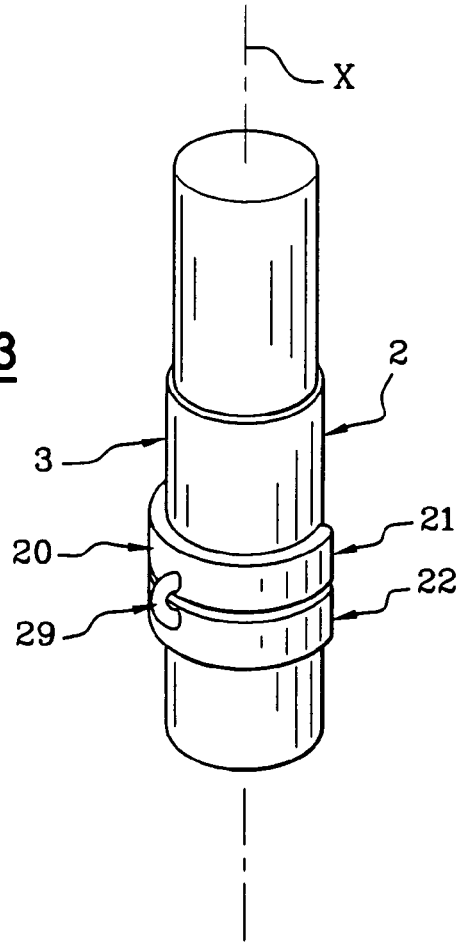
FIG. 3 shows the assembly of FIG. 2, in which the items have been removed with the two fixing elements being fastened to a single item.

As seen in FIG. 2, assembly 1 is shown in assembled form. In this position, loop 21 is latched to case 3 and loop 22 is latched to case 13. Thus, case 3 and 13 are being held more or less fixed in relation to one another.

When the two items 2 and 12 have to be separated, one of the items, for example item 12, is removed from the fixing device 20. Loop 22 is then folded back by 180° in such a way as to engage by latching on item 2, by positioning itself below the portion of loop 21. The link strip 29 permits this maneuverability by the device 20. As can be seen in FIG. 3, in this configuration, the dimensions of the case 2 have not noticeably increased.

Figure 4A:
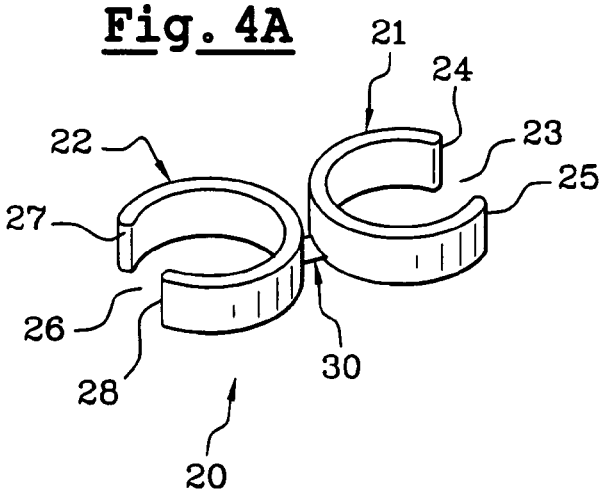
FIGS. 4A and 4B show a variant of the fastening device used in FIGS. 1-3.
Figure 4B:
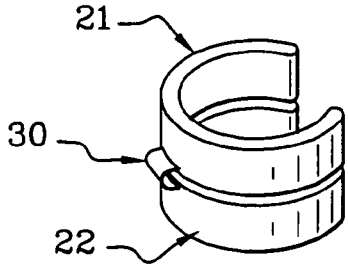

In additional embodiments of the present invention as shown in FIGS. 4A and 4B, the link strip 29 may be replaced by a film hinge 30. The device according to this embodiment is otherwise identical in all respects to that of the previous embodiment.

In the above detailed description, reference is made to preferred embodiments of the invention. It is clear that variations can be made to these without deviating from the spirit of the present invention as claimed.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A device for the combined presentation of first and second items, the device comprising:

a first element detachably securable to the first item and the second item, the first element including a pair of arms having free ends defining a first opening therebetween, the pair of arms being disposed on opposite sides of a central axis and being resiliently displaceable relative to one another so as to securely engage the first item and the second item;

a second element detachably securable to the first item and the second item, the second element including a pair of arms having free ends defining a second opening therebetween, the pair of arms being disposed on opposite sides of a central axis and being resiliently displaceable relative to one another so as to securely engage the first item and the second item; and a connecting member having a first end connected to the first element opposite the first opening and having a second end connected to the second element opposite the second opening, the connecting member being resiliently foldable between a relaxed configuration in which the first element and the second element are substantially coplanar and the first opening faces away from the second opening, and a folded configuration in which the first element is coaxially aligned with the second element.

2. The device according to claim 1, wherein the free ends of the pair of arms of the first element are spaced apart by a first distance in a nonuse condition in which the first element is not engaged with the first item or the second item, the first distance being less than cross-sectional sizes of the first item and the second item, wherein the pair of arms of the first element resiliently deform so that the free ends of the first element are spaced apart by a distance greater than the first distance to receive the first item and/or the second item.

3. The device according to claim 2, wherein the free ends of the pair of arms of the second element are spaced apart by a first distance in a nonuse condition in which the second element is not engaged with the first item or the second item, the first distance being less than cross-sectional sizes of the first item and the second item, wherein the pair of arms of the second element resiliently deform so that the free ends of the second element are spaced apart by a distance greater than the first distance to receive the first item and/or the second item.

4. A device according to claim 1, wherein the pair of arms of the first element together form a portion of a circle, the portion of the circle extending at least 180° from the free end of one arm of the pair of arms to the free end of another arm of the pair of arms.

5. A device according to claim 4, wherein the portion of the circle extends between 190°-310° from the free end of the one arm of the pair of arms to the free end of the another arm of the pair of arms.

6. A device according to claim 4, wherein the pair of arms of the second element together form a portion of a circle, the portion of the circle extending at least 180° from the free end of one arm of the pair of arms to the free end of another arm of the pair of arms.

7. The device according to claim 1, wherein the device is formed from at least one moldable thermoplastic material.

8. The device according to claim 1, wherein the pair of arms of the first element define an internal circular cross-section and the pair of arms of the second element define an internal circular cross-section.

9. The device according to claim 1, wherein the first element has a size and shape and the second element has a size and shape which are the same as the size and shape of the first element.

10. A device for the combined presentation of first and second items, the device comprising:

a first element detachably securable to the first item and the second item, the first element having a first surface and a second surface opposite the first surface, the first element including a pair of arms having free ends, the pair of arms being disposed on opposite sides of a central axis and being resiliently displaceable relative to one another so as to securely engage the first item and the second item;

a second element detachably securable to the first item and the second item, the second element having a first surface and a second surface opposite the first surface, the second element including a pair of arms having free ends, the pair of arms being disposed on opposite sides of the central axis and being resiliently displaceable relative to one another so as to securely engage the first item and the second item; and a connecting member interconnecting the first element and the second element, the connecting member lying along the central axis, being foldable in a first direction so that the first surface of the first element confronts the first surface of the second element, and being foldable in a second direction so that the second surface of the first element confronts the second surface of the second element, the folding of the connecting member not substantially deforming the first element and the second element.

11. A device according to claim 10, wherein the free ends of the pair of arms of the first element are spaced apart by a first distance in a nonuse condition in which the first element is not engaged with the first item or the second item, the first distance being less than cross-sectional sizes of the first item and the second item, wherein the pair of arms of the first element resiliently deform so that the free ends of the first element are spaced apart by a distance greater than the first distance to receive the first item and/or the second item.

12. A device according to claim 11, wherein the free ends of the pair of arms of the second element are spaced apart by a first distance in a nonuse condition in which the second element is not engaged with the first item or the second item, the first distance being less than cross-sectional sizes of the first item and the second item, wherein the pair of arms of the second element resiliently deform so that the free ends of the second element are spaced apart by a distance greater than the first distance to receive the first item and/or the second item.

13. A device according to claim 10, wherein the pair of arms of the first element together form a portion of a circle, the portion of the circle extending at least 180° from the free end of one arm of the pair of arms to the free end of another arm of the pair of arms.

14. A device according to claim 13, wherein the portion of the circle extends between 190°-310° from the free end of the one arm of the pair of arms to the free end of the another arm of the pair of arms.

15. A device according to claim 13, wherein the pair of arms of the second element together form a portion of a circle, the portion of the circle extending at least 180° from the free end of one arm of the pair of arms to the free end of another arm of the pair of arms.

16. A device according to claim 10, wherein the device is formed from at least one moldable thermoplastic material.

17. A device according to claim 10, wherein the connecting member is foldable between a relaxed configuration in which the first element and the second element are substantially coplanar, and a folded configuration in which the first element is coaxially aligned with the second element.

18. A device according to claim 10, wherein the pair of arms of the first element define an internal cross-section and the pair of arms of the second element define an internal cross-section, the internal cross-sections of the first element and the second element corresponding to cross-sections of the first item and the second item.

19. A device according to claim 18, wherein the cross-sections of the first item and the second item and the internal cross-sections of the first element and the second element are circular.

20. A device according to claim 19, wherein the internal cross-section of at least one of the first element and the second element is less than or equal to the cross-section of one of the first item or the second item.

21. A device according to claim 19, wherein the internal cross-section of at least one of the first element and the second element is between 1 and 10 percent less than the cross-section of one of the first item or the second item.

22. A device according to claim 10, wherein the first element has a size and a shape, and the second element has a size and a shape which are the same as the size and the shape of the first element.

23. An assembly for attaching two discrete bodies, comprising:

a first item in the form of a first receptacle containing a first product;

a second item; and a device including a first element, a second element, and a connecting member, the first element being detachably securable to the first item and the second item, the first element including a pair of arms having free ends defining a first opening therebetween, the pair of arms being disposed on opposite sides of a central axis and being resiliently displaceable relative to one another so as to securely engage the first item and the second item; the second element being detachably securable to the first item and the second item, the second element including a pair of arms having free ends defining a second opening therebetween, the pair of arms being disposed on opposite sides of a central axis and being resiliently displaceable relative to one another so as to securely engage the first item and the second item; and the connecting member having a first end connected to the first element opposite the first opening and having a second end connected to the second element opposite the second opening, the connecting member being resiliently foldable between a relaxed configuration in which the first element and the second element are substantially coplanar and the first opening faces away from the second opening, and a folded configuration in which the first element is coaxially aligned with the second element, wherein the first element and the second element can simultaneously attach either to the first item, to the second item or to the first item and the second item, such that the first item and the second item may be stacked one on top of the other or adjacent to one another without substantially deforming the first element and the second element.

24. An assembly according to claim 23, wherein the first item and the second item each has a cross-section which is at least partly circular.

25. An assembly according to claim 23, wherein the second item is an accessory for the application of the first product.

26. An assembly according to claim 23, wherein the second item is a receptacle for a second product different from the first product.

27. An assembly according to claim 26, wherein the first product is make-up for the lips or eyelashes and the second product is a product that modifies the appearance of the first product.

* * * * *